US005841033A

United States Patent [19]

Burris et al.

[11] Patent Number: 5,841,033

[45] Date of Patent: Nov. 24, 1998

[54] PROCESS FOR IMPROVING FATIGUE RESISTANCE OF A COMPONENT BY TAILORING COMPRESSIVE RESIDUAL STRESS PROFILE, AND ARTICLE

[75] Inventors: Kenneth W. Burris; Thomas E. Clements, both of Peoria, Ill.

[73] Assignee: Caterpillar Inc., Peoria, Ill.

[21] Appl. No.: 769,283

[22] Filed: Dec. 18, 1996

[51] Int. Cl.[6] ..... G01N 19/08

[52] U.S. Cl. ..... 73/799; 73/760; 72/362; 148/225

[58] Field of Search ..... 73/760, 799; 72/362, 72/365.2, 369; 148/225, 233

[56] References Cited

U.S. PATENT DOCUMENTS

| | | | |
|---|---|---|---|
| 3,652,346 | 3/1972 | Tomita et al. | 148/154 |
| 4,034,585 | 7/1977 | Straub | 72/362 |
| 4,191,599 | 3/1980 | Stickets et al. | 148/233 |
| 5,079,955 | 1/1992 | Eberhardt | 73/799 |

*Primary Examiner*—Max H. Noori
*Attorney, Agent, or Firm*—Pankaj M. Khosla; Kevin M. Kercher

[57] ABSTRACT

A process for improving fatigue resistance of a case hardened component having a case thickness "t", subjected to one or more of rolling, sliding, abrasion, bending and pitting includes determining the magnitude of fatigue strength at surface and at a plurality of pre-selected points along thickness "t" of a component. The applied fatigue stresses acting upon the component at the surface and at the plurality of pre-selected points along thickness "t" are also determined. Then, a compressive residual stress profile is tailored from the surface to thickness "t" of the component. The compressive residual stresses at the surface and at the plurality of the pre-selected points along thickness "t" respectively have a magnitude sufficient to attain a net resultant stress which is at least 25% lower than the fatigue strength at the surface and the corresponding plurality of pre-selected points.

15 Claims, 2 Drawing Sheets

PROCESS FOR IMPROVING FATIGUE RESISTANCE OF A COMPONENT BY TAILORING COMPRESSIVE RESIDUAL STRESS PROFILE, AND ARTICLE

TECHNICAL FIELD

The present invention relates generally to a process for improving fatigue resistance of a case hardened component and more particularly, to a process for improving fatigue resistance by tailoring a predetermined compressive residual stress profile in the case of a case hardened component through selective application of carbon gradient.

BACKGROUND ART

Bearings, track rollers, gears, bushings and other rolling, sliding, bending and wear components used in the transmissions and undercarriages in earthworking machines are required to possess a combination of one or more of abrasion resistance, fracture toughness, and bending and pitting fatigue resistance. In the case of gears for example, many variables such as steel composition, steel cleanliness, heat treatment, microstructure, surface finish, tooth geometry and resultant stresses affect bending fatigue resistance.

One method of increasing the durability and reliability of these steel components is case hardening. Case hardening results in the component having a harder outer surface and a relatively softer inner core and is accomplished by methods such as carburizing.

It is known that in the carburization of steel components, the carbon potential controls the Martensite Start (Ms) temperature. A diffusion controlled process such as carburization typically yields a high carbon level at the surface of the article. This carbon level at the surface gradually reduces to a lower carbon level at the core of the carburized article. The above described carbon gradient profile results in the article having an Ms gradient profile wherein the Ms is lower at the surface and gradually increases at the core of the article.

It is also known that residual stresses are generated in heat treated components from the volumetric increase that occurs when austenite changes to martensite during quenching. Carburized components generate compressive residual stresses because of the differential change in the Ms temperature throughout the case.

Until the research work done by the inventors of the present application, it was not well understood as to how article size, case depth, material hardenability and surface carbon affect compressive residual stress profiles in a case hardened component. It was also not well understood which specific criterion most significantly impacts the residual stresses. This inability to understand and tailor a component's fatigue performance to enable the component to exhibit a predetermined amount of net resultant stress in response to a subjected deflection or load has long been a bottleneck in the design of such transmission and undercarriage components for increased fatigue life.

It has been desirable to reduce the compressive residual stress at the surface of a transmission and/or undercarriage component to flatten out the area of contact. It has also been desirable to tailor the compressive residual stress profile of a component to counter the applied fatigue stresses acting upon the component and thereby lower the net resultant stresses that the component is subjected to, thereby improving the component's fatigue resistance. In other words, it has been desirable to form components which are tailored to exhibit predetermined amounts of compressive residual stresses vs. depth of component so as to obtain components that exhibit a desired amount of fatigue resistance enhancement.

The present invention is directed to overcome one or more problems encountered in the design of fatigue resistant components, as set forth above.

DISCLOSURE OF THE INVENTION

In one aspect of the present invention, a process for improving fatigue resistance of a case hardened component having a case thickness "t", subjected to one or more of rolling, sliding, abrasion, bending and pitting is disclosed. The magnitude of fatigue strength at surface of the component and at a plurality of pre-selected points along thickness "t" of the component, is determined in response to a load subjected upon the component. The magnitude of applied fatigue stresses acting upon the component at the surface and at the plurality of pre-selected points along thickness "t" of the component is determined. A compressive residual stress profile is tailored from the surface to thickness "t" of the component. The profile consists of an upper compressive residual stress profile, a lower compressive residual stress profile, and a plurality of compressive residual stress profiles within the area bounded between the upper and lower compressive residual stress profiles. The compressive residual stresses at the surface and at the plurality of the pre-selected points along thickness "t" respectively have a magnitude sufficient to attain a net resultant stress which is at least 25% lower than the fatigue strength at the surface and the corresponding plurality of pre-selected points.

In another aspect of the present invention, a case hardened component having improved fatigue resistance and being subjected to one or more of rolling, sliding, abrasion, bending and pitting is disclosed. The component has a surface and a case thickness "t". A compressive residual stress profile is tailored from the surface to thickness "t" of the component. The compressive residual stresses at the surface and at the plurality of the pre-selected points along thickness "t" respectively have a magnitude sufficient to attain a net resultant stress which is at least 25% lower than the fatigue strength at the surface and the corresponding plurality of pre-selected points.

In yet another aspect of the present invention, a case hardened gear having improved fatigue resistance is disclosed.

BEST MODE FOR CARRYING OUT THE INVENTION

Figure 1:
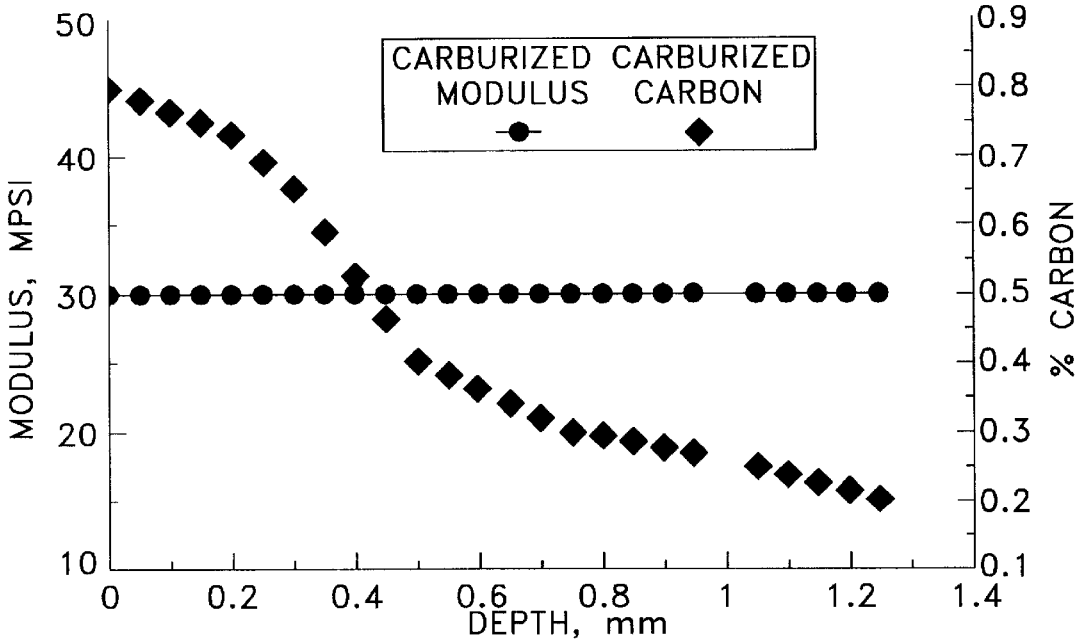
FIG. 1 is a graphical illustration of the conventional carbon gradient profile of a case hardened component.

As used in this description and in the claims, the term "rolling" describes the contact between two bodies wherein the motion of one surface relative to the other surface can be described with a linear velocity as well as a rotational velocity. The term "rolling" includes contacts where the surface velocities at the point of contact are equal and parallel, such as for example, in anti-friction bearings. The term "rolling" also includes contacts where a significant difference in the surface velocities occurs due to a sliding component of the contact, such as for example, in gears.

As used in this description and in the claims, the term "sliding" describes the contact between two bodies where the motion of one surface relative to the second surface is described with a velocity vector which coincides with the contact interface. Fuel injector plunger, barrel assemblies, and journal bearings are some examples of components subjected to sliding contacts.

As used in this description and in the claims, the term "abrasion" describes a contact between two surfaces where material is removed from one surface by the combined force and velocity of the second surface. This material removal can be large, for example, in abrasive wear of GET's, and small and localized, for example, in the scoring of gear teeth.

As used in this description and in the claims, the term "bending" describes the area of contact between two bodies where a load is applied in a cantilever manner to the component, which creates resultant stresses in the component away from the area of contact. For example, GET's such as bucket tips are subjected to bending contacts.

The term "carburization", "carburizing", and "carbon potential", as used herein have the same meaning as is generally understood by those skilled in the thermochemical process of heat treatment and case hardening by carburization. Carburization is a well known technique and need not be described here in any further detail.

The term "case", as used herein, is the hardened outer shell of a component. The hardened case may be obtained by carburization or by the deposition of a functionally gradient material. The term "case thickness "t"" means distance below the surface of the steel, where the carbon content in austenite is substantially equal to the carbon content in the base steel composition.

As used in this description and in the claims, the term "functionally gradient materials" means a material which has a continuously varying composition and/or microstructure from one boundary to another.

The term "thermally spraying", as used herein means the thermal spray techniques such as, oxyacetylene torch thermal spray, gas stabilized plasma spray, water stabilized plasma spray, combustion thermal spray, and high velocity oxygen fueled spray (HVOC). It must be understood that the thermal spray techniques are not limited to the above enumerated methods and that other alternative thermal spray techniques known to those skilled in the art may be employed. A technical publication titled "Thermal Spray Processing of FGMs", by S. Sampath, H. Herman, N. Shimoda, and T. Saito, published in the MRS Bulletin, pages 27–31, January 1995, and which is incorporated herein by reference, discloses a thermal spray method of depositing FGMs. Another technical article titled "Advanced Thermal Spray Coatings for Corrosion and Wear Resistance", by R. C. Rucker, Jr., and A. A. Ashary, published in Advances in Coatings Technologies for Corrosion and Wear Resistant Coatings, 1995, pages 89–98 describes various thermal spray processes, and is incorporated herein by reference.

The term "bonded" as used herein means a bond of a thermally sprayed coating to a substrate due to mechanical interlocking with asperities on the surface of the substrate. This mechanical interlocking is obtained by roughening the surface of the substrate, say, by grit blasting. The bond strengths of coatings are measured by ASTM Recommended Practice C633.

In the preferred embodiment of the present invention, a process for improving fatigue resistance of a case hardened component having a case thickness "t", subjected to one or more of rolling, sliding, abrasion, bending and pitting includes the following steps.

The magnitude of a load acting upon a component is determined. Then, the magnitude of fatigue strength at surface of the component and at a plurality of pre-selected points along thickness "t" of the component, is determined in response to a load subjected upon the component. This may be accomplished by various means known to those skilled in the art of determining fatigue properties. The magnitude of applied fatigue stresses acting upon the component at the surface and at the plurality of pre-selected points along thickness "t" of the component is determined. Methods such as Finite Element Analysis and X-Ray Diffration are used for such determination. One skilled in the art can develop suitable fatigue stress profiles for a certain type of a contact situation without undue experimentation by simply conducting a finite element analysis (FEA) of the component in a dynamic load situation by computer simulation.

A compressive residual stress profile is tailored from the surface to thickness "t" of the component. The profile consists of an upper compressive residual stress profile, a lower compressive residual stress profile, and a plurality of compressive residual stress profiles within the area bounded between the upper and lower compressive residual stress profiles. It is important that the compressive residual stresses built into the component at the surface and along the case depth be such that at any given point in the case depth, the sum total of the compressive residual stress and the applied fatigue stress be less than the determined fatigue strength at that point. Thus, it is preferable that compressive residual stresses at the surface and at the plurality of the pre-selected points along thickness "t" respectively have a magnitude sufficient to attain a net resultant stress which is at least 25% lower than the fatigue strength at the surface and the corresponding plurality of pre-selected points.

The term "net resultant stress", as used herein, is the sum total of the compressive residual stress and the applied fatigue stress at a given point.

In the preferred embodiment, the upper compressive residual stress profile consists of −400 Mpa at surface; −50 Mpa at 40% of thickness "t"; 0.0 Mpa at 50% of thickness "t" and 0.0 Mpa at 100% of thickness "t and the lower compressive residual stress profile consists of −600 Mpa at surface; −100 Mpa at 40% of thickness "t"; −50 Mpa at 50% of thickness "t"; and 0.0 Mpa at 100% of thickness "t. It is desirable to have a compressive residual stress of at least −400 Mpa at the surface in order for the component to exhibit high fatigue resistance, particularly, bending and pitting fatigue resistance.

In the preferred embodiment of the present invention, the compressive residual stress profile is attained by imparting a carbon gradient in the case. The carbon gradient may be imparted by controlling the carbon potential during carburization. Preferably, the carbon potential is imparted into the case by forming the case from an FGM coating and metering in precise amounts of carbon while the FGM material is being thermally sprayed onto the component to form the hard FGM coating or a "case".

The FGM is desirably thermally sprayed by plasma spray. An FGM coating is formed on the surface. The FGM coating desirably has a thickness in the range of about 0.5 mm to about 20 mm and preferably, 0.5 mm to 2 mm. A thickness less than 0.5 mm is undesirable because it is too thin to tailor a carbon profile by varying the carbon in the FGM composition. A thickness greater than 20 mm is undesirable because an excessively thick case may reduce fatigue life.

In the preferred embodiment, the upper carbon gradient profile consists of 0.8 wt % carbon at the FGM coating surface, i.e., the "new" surface; 1.0 wt % carbon at 20% of thickness "t"; 0.4 wt % carbon at 75% of thickness "t"; and 0.3 wt % carbon at 100% of thickness "t"; and the lower carbon gradient profile consists of 0.5 wt % carbon at surface; 0.7 wt % carbon at 20% of thickness "t"; 0.2 wt % carbon at 75% of thickness "t"; 0.2 wt % carbon at 100% of thickness "t".

The usual steps of cleaning the component surface, such as cleaning by solvents, de-greasing, grit blasting, chemical etching and ultra-sonic cleaning are carried out prior to the thermal spraying of the FGM coating or case.

In the preferred embodiment of the present invention, the FGM may be formed from metal, ceramic or cermets. The ceramics used may be one of titanium carbide (TiC), tungsten carbide (WC), $Cr_2C3$, $BC_4$ and mixtures thereof. The metal is desirably one of SAE 4000, 4100, 4360, 4600, 8600, 8800 or 9300 steels, or mixtures thereof. Examples of cermets include metal and ceramics, such as for example, Nickel-Chromium-Aluminum-Yttria alloy (NiCrAlY), Nickel-Chromium (NiCr) with Partially Stabilized Zirconia (PSZ), NiCrAlY with $ZrO_2$ and $Y_2O_3$, nickel with $Al_2O_3$, tungsten carbide, and cobalt-chrome carbide.

The following Example A illustrates the process of the present invention, wherein a case hardened component, such as a gear for example, is thermally sprayed desirably with an SAE grade 4600 to form a bonded steel case of about 1.3 mm thickness.

EXAMPLE A

Figure 2:
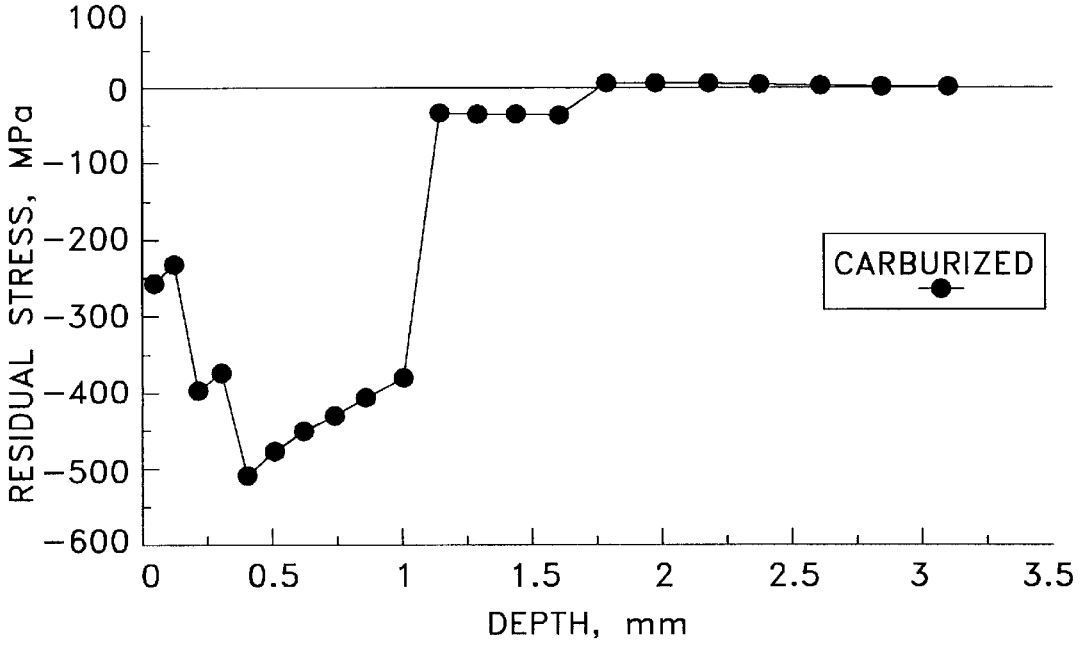
FIG. 2 is a graphical illustration of the conventionally attained compressive residual stresses in the case hardened component of FIG. 1.
Figure 3:
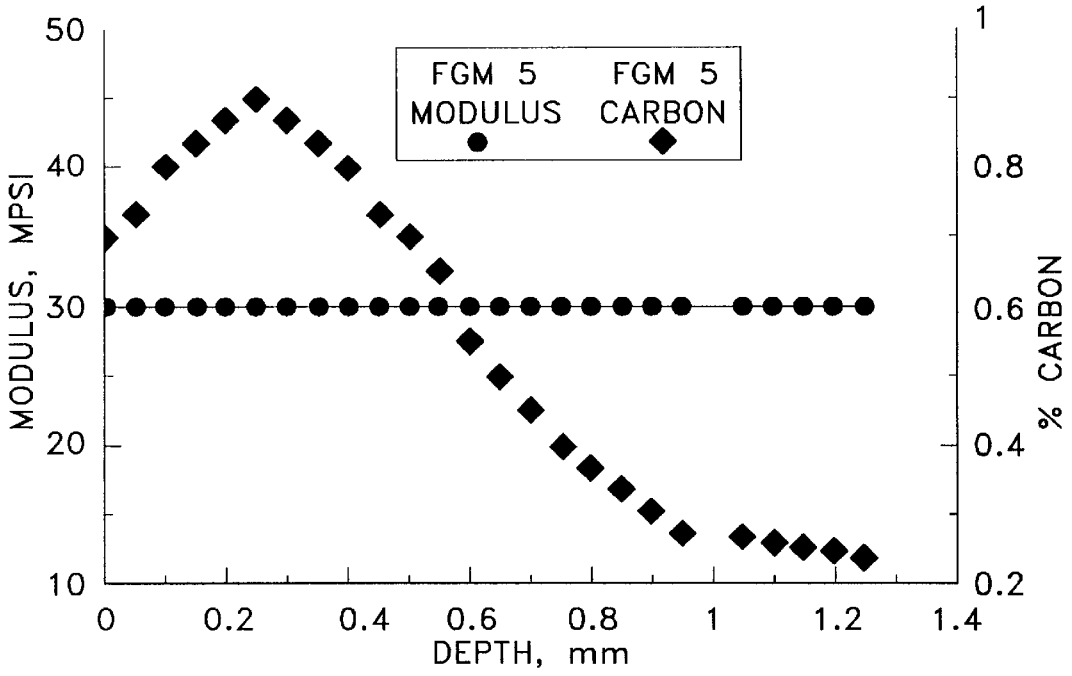
FIG. 3 is a graphical illustration of the tailored carbon gradient profile of a case hardened component, according to an exemplary embodiment of the present invention.
Figure 4:
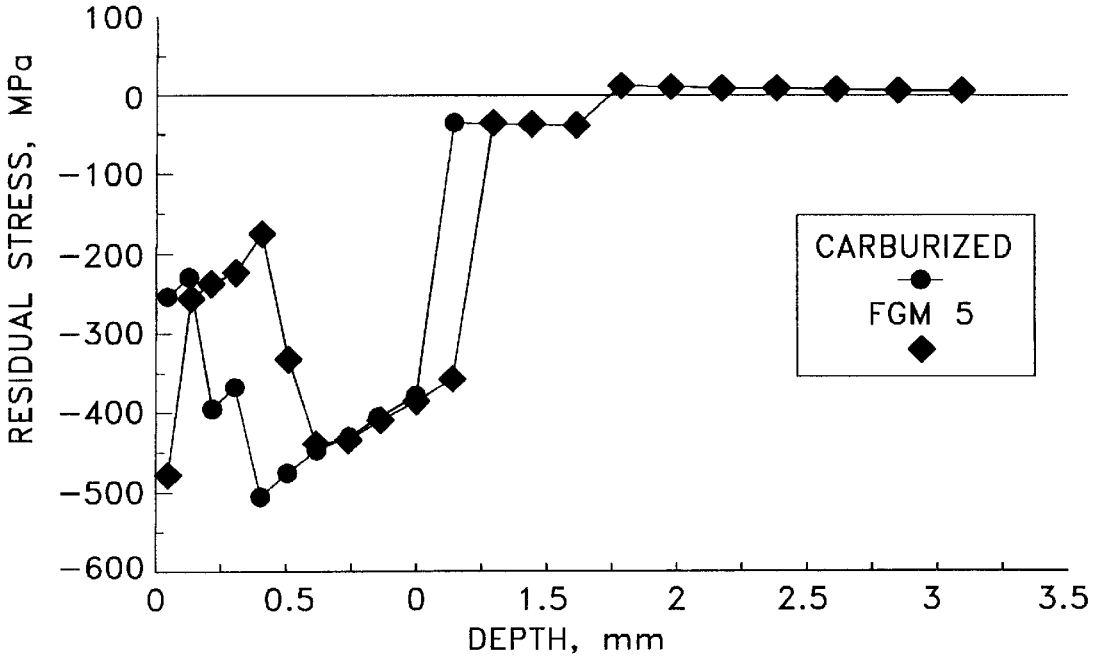
FIG. 4 is a graphical illustration of the tailored compressive residual stress profile in the case hardened component of FIG. 3, according to an exemplary embodiment of the present invention.

The composition of the SAE 4600 steel is as follows, by weight percent: Si 0.005%, Mn 0.17%, P 0.006%, S 0.015%, Cr 0.03%, Ni 1.78%, Mo 0.54%, Cu 0.09%, Al 0%, Co 0%, V 0%, W 0%, N less than 0.001%, O 1100 ppm and balance iron. This steel composition is manufactured by Hoeganaes Corporation under the trade name "Ancorsteel 4600". Into this steel composition, a precise amount of carbon is added while building up the case thickness during thermal spraying to impart a carbon gradient profile to the FGM case, as shown in FIG. 3 and resultantly impart a tailored compressive residual stress profile, as shown in FIG. 4. The results in FIG. 3 and FIG. 4 are compared with the results in FIG. 1 and FIG. 2 which represent a conventional carbon gradient in a case hardened component and the resulting compressive residual stresses respectively. The component represented in FIG. 4 exhibits increased fatigue life, particularly, bending and pitting fatigue life as compared to the component represented in FIG. 2.

Industrial Applicability

The present invention is useful for making fatigue resistant components that are constantly subjected to one or more of rolling, sliding, abrasion and bending contacts. Such components are typically various types of bearings and gears used in vehicle undercarriages, engines and transmissions; track rollers and track links for the tracks of track-type tractors and earthmoving equipment; camshafts and rocker arms for engines, planet shafts for planetary transmissions, and GETs.

Other aspects, objects and advantages of this invention can be obtained from a study of the drawings, the disclosure and the appended claims.

We claim:

1. A process for improving fatigue resistance of a case hardened component having a case thickness "t", subjected to one or more of rolling, sliding, abrasion, bending and pitting, comprising the steps of:

determining the magnitude of a load acting upon said component;

determining the magnitude of fatigue strength at surface of said component and at a plurality of pre-selected points along thickness "t" of said component, in response to said load;

determining the magnitude of applied fatigue stresses acting upon said component at said surface of said component and at said plurality of pre-selected points along thickness "t" of said component;

applying a compressive residual stress profile from said surface to thickness "t" of component consisting of:

an upper compressive residual stress profile, a lower compressive residual stress profile, and a plurality of compressive residual stress and profiles within the area bounded between said upper and lower compressive residual stress profiles;

said compressive residual stresses at said surface and at said plurality of said pre-selected points along thickness "t" respectively having a magnitude sufficient to attain a net resultant stress being at least 25% lower than said fatigue strength at said surface and said corresponding plurality of pre-selected points, said upper compressive residual stress profile consists of:

−400 Mpa at surface;

−50 Mpa at 40% of thickness "t";

0.0 Mpa at 50% of thickness "t"; and 0.0 Mpa at 100% of thickness "t";

and said lower compressive residual stress profile consists of:

−600 Mpa at surface;

−100 Mpa at 40% of thickness "t";

−50 Mpa at 50% of thickness "t"; and 0.0 Mpa at 100% of thickness "t".

2. A case hardened gear having improved fatigue resistance, a case thickness "t", subjected to one or more of rolling, sliding, abrasion, bending and pitting, made by a process comprising the steps of:

determining the magnitude of a load acting upon said gear;

determining the magnitude of fatigue strength at surface of said gear and at a plurality of pre-selected points along thickness "t" of said gear, in response to said load;

determining the magnitude of applied fatigue stresses acting upon said gear at said surface of said gear and at said plurality of pre-selected points along thickness "t" of said gear;

applying a compressive residual stress profile from said surface to thickness "t" of gear consisting of:

an upper compressive residual stress profile, a lower compressive residual stress profile, and a plurality of compressive residual stress profiles within the area bounded between said upper and lower compressive residual stress profiles;

said compressive residual stresses at said surface and at said plurality of said pre-selected points along thickness "t" respectively having a magnitude sufficient to attain a net resultant stress being at least 25% lower than said fatigue strength at said surface and said corresponding plurality of pre-selected points, −400 Mpa at surface;
−50 Mpa at 40% of thickness "t";
0.0 Mpa at 50% of thickness "t"; and
0.0 Mpa at 100% of thickness "t";

and said lower compressive residual stress profile consists of:

−600 Mpa at surface;
−100 Mpa at 40% of thickness "t";
−50 Mpa at 50% of thickness "t"; and
0.0 Mpa at 100% of thickness "t".

3. A process, as set forth in claim 1, wherein said compressive residual stress profile is applied by imparting a carbon gradient at said surface and at said plurality of pre-selected points along said depth.

4. A process, as set forth in claim 3, wherein said carbon gradient is imparted by changing the carbon potential of the carburizing atmosphere during carburization of said component.

5. A process, as set forth in claim 3, wherein said carbon gradient is imparted by coating said component with a functionally gradient material having a pre-selected carbon gradient by a process, comprising the steps of:

thermally spraying a functionally gradient material (FGM) on said surface and forming an FGM coated component having a new surface, said FGM coating having a thickness "t" and a carbon gradient profile from said new surface to said thickness "t", consisting of:

an upper carbon gradient profile, a lower carbon gradient profile, and a plurality of carbon gradient profiles within the area bounded between said upper and lower carbon gradient profiles;

said upper carbon gradient profile consisting of:

0.8 wt % carbon at new surface;
1.0 wt % carbon at 20% of thickness "t";
0.4 wt % carbon at 75% of thickness "t";
0.3 wt % carbon at 100% of thickness "t";

and said lower carbon gradient profile consisting of:

0.5 wt % carbon at new surface;
0.7 wt % carbon at 20% of thickness "t";
0.2 wt % carbon at 75% of thickness "t";
0.2 wt % carbon at 100% of thickness "t".

6. A process, as set forth in claim 5, wherein said FGM is selected from one of ceramics, metals, cermets, or mixtures thereof.

7. A case hardened component having improved fatigue resistance, a case thickness "t", subjected to one or more of rolling, sliding, abrasion, bending and pitting, comprising:

a compressive residual stress profile from said surface to thickness "t" of component consisting of:

an upper compressive residual stress profile,
a lower compressive residual stress profile, and
a plurality of compressive residual stress profiles within the area bounded between said upper and lower compressive residual stress profiles;

said compressive residual stresses at said surface and at said plurality of said pre-selected points along thickness "t" respectively having a magnitude sufficient to attain a net resultant stress being at least 25% lower than fatigue strength at said surface and said corresponding plurality of pre-selected points, said upper compressive residual stress profile consists of:

−400 Mpa at surface;
−50 Mpa at 40% of thickness "t";
0.0 Mpa at 50% of thickness "t"; and
0.0 Mpa at 100% of thickness "t";

and said lower compressive residual stress profile consists of:

−600 Mpa at surface;
−100 Mpa at 40% of thickness "t";
−50 Mpa at 50% of thickness "t"; and
−0.00 Mpa at 100% of thickness "t".

8. A case hardened gear, as set forth in claim 2, wherein said compressive residual stress profile is applied by imparting a carbon gradient at said surface and at said plurality of pre-selected points along said depth.

9. A case hardened component, as set forth in claim 7, wherein said compressive residual stress profile is applied by imparting a carbon gradient at said surface and at said plurality of pre-selected points along said depth.

10. A case hardened component, as set forth in claim 9, wherein said carbon gradient is imparted by changing the carbon potential of the carburizing atmosphere during carburization of said component.

11. A case hardened component, as set forth in claim 9, wherein said carbon gradient is imparted by coating said component with a functionally gradient material having a pre-selected carbon gradient by a process, comprising the steps of:

thermally spraying a functionally gradient material (FGM) on said surface and forming an FGM coated component having a new surface, said FGM coating having a thickness "t" and a carbon gradient profile from said new surface to said thickness "t", consisting of:

an upper carbon gradient profile, a lower carbon gradient profile, and a plurality of carbon gradient profiles within the area bounded between said upper and lower carbon gradient profiles;

said upper carbon gradient profile consisting of:

0.8 wt % carbon at new surface;
1.0 wt % carbon at 20% of thickness "t";
0.4 wt % carbon at 75% of thickness "t";
0.3 wt % carbon at 100% of thickness "t";

and said lower carbon gradient profile consisting of:

0.5 wt % carbon at new surface;
0.7 wt % carbon at 20% of thickness "t";
0.2 wt % carbon at 75% of thickness "t";
0.2 wt % carbon at 100% of thickness "t".

12. A case hardened component, as set forth in claim 11, wherein said FGM is selected from one of ceramics, metals, cermets, or mixtures thereof.

13. A case hardened gear, as set forth in claim 8, wherein said carbon gradient is imparted by changing the carbon potential of the carburizing atmosphere during carburization of said gear.

14. A case hardened gear, as set forth in claim 8, wherein said carbon gradient is imparted by coating said gear with a functionally gradient material having a pre-selected carbon gradient by a process, comprising the steps of:

thermally spraying a functionally gradient material (FGM) on said surface and forming an FGM coated gear having a new surface, said FGM coating having a thickness "t" and a carbon gradient profile from said new surface to said thickness "t", consisting of:

an upper carbon gradient profile, a lower carbon gradient profile, and a plurality of carbon gradient profiles within the area bounded between said upper and lower carbon gradient profiles;

said upper carbon gradient profile consisting of:

0.8 wt % carbon at new surface;

1.0 wt % carbon at 20% of thickness "t";

0.4 wt % carbon at 75% of thickness "t";

0.3 wt % carbon at 100% of thickness "t";

and said lower carbon gradient profile consisting of:

0.5 wt % carbon at new surface;

0.7 wt % carbon at 20% of thickness "t";

0.2 wt % carbon at 75% of thickness "t";

0.2 wt % carbon at 100% of thickness "t".

15. A case hardened gear, as set forth in claim 14, wherein said FGM is selected from one of ceramics, metals, cermets, or mixtures thereof.

* * * * *